United States Patent [19]

Hala

[11] 3,964,227

[45] June 22, 1976

[54] ANCHORING APPARATUS FOR FIXEDLY SPACING MULTIPLE WALL CONSTRUCTIONS

[75] Inventor: Alfred A. Hala, Islip, N.Y.

[73] Assignee: Hohmann & Barnard, Inc., Hauppauge, N.Y.

[22] Filed: Sept. 27, 1974

[21] Appl. No.: 510,053

[52] U.S. Cl. ..... 52/568; 52/713

[51] Int. Cl.[2] ..... E04B 2/30

[58] Field of Search ..... 52/568, 378, 379, 428, 52/712–714, 509

[56] References Cited

UNITED STATES PATENTS

| | | | |
|---|---|---|---|
| 779,268 | 1/1905 | Elliott | 52/428 |
| 1,079,115 | 11/1913 | Denison | 52/428 |
| 2,174,844 | 10/1939 | Sedore | 52/307 |
| 3,300,939 | 1/1967 | Brynjolfsson et al. | 52/713 |
| 3,309,828 | 3/1967 | Tribble | 52/713 |
| 3,342,004 | 9/1967 | Lucas | 52/428 |
| 3,353,312 | 11/1967 | Storch | 52/713 |
| 3,377,764 | 4/1968 | Storch | 52/713 |
| 3,535,846 | 10/1970 | Storch | 52/509 |

FOREIGN PATENTS OR APPLICATIONS

| | | | |
|---|---|---|---|
| 575,399 | 5/1959 | Canada | 52/712 |
| 19,949 | 9/1906 | United Kingdom | 52/712 |

*Primary Examiner*—Ernest R. Purser
*Attorney, Agent, or Firm*—Philip D. Amins

[57] ABSTRACT

There is herein provided anchoring apparatuses, systems and methods for wall systems employing an inner wythe and outer wythe construction. The inner wythe is fabricated of block construction while the outer wythe may take the form of block or stone construction. An elongated substantially longitudinal member is positionally disposed in fixed relationship between the inner and outer wythes and is positionally secured with respect to said inner wythe by means of a plurality of members interconnected between said inner wythe and said elongated member. A wall-tie element has the outer end thereof secured to said elongated longitudinal member and the inner end thereof is secured to said outer wythe, thereby securing said inner wythe to said outer wythe. The wall-tie element is initially adjustable by movement along said elongated longitudinal member to facilitate the positional disposition of said wall-tie element with respect to said elongated longitudinal member.

94 Claims, 25 Drawing Figures

ANCHORING APPARATUS FOR FIXEDLY SPACING MULTIPLE WALL CONSTRUCTIONS

BACKGROUND OF THE INVENTION

The present invention pertains to new and novel anchoring apparatuses, systems and methods for use in conjunction with wall systems which employ double wythe construction, i.e., an inner wythe and an outer wythe. Moreover, the present invention contemplates adjustability of the anchoring system so as to accommodate the same for use with various type inner wythe constructions and various type outer wythe constructions. Moreo ver, the adjustability compensates for variations or misalignment of corresponding courses of the wythes. Although the inner wythe is hereindescribed as being of block construction, it is within the realm of the teachings of the present invention to provide an inner wythe fabricated of different material and construction.

The present invention pertains to anchoring systems which may be used in conjunction with or in lieu of the systems disclosed in my copending U.S. application entitled ADJUSTABLE WALL-TIE REINFORCING SYSTEM, assigned to the Assignor of the present invention and filed concomitantly herewith.

SUMMARY OF THE INVENTION

It is the primary object of the present invention to provide a new and novel anchoring system for use in the construction of wall systems of double wythe design and fabrication.

It is another object of the present invention to provide an anchoring system of the foregoing type wherein wall-ties are adjustably positionable with respect to the inner and outer wythes of said wall systems, so as to facilitate the construction thereof.

It is a more particular object of the present invention to provide an anchoring system of the foregoing type for use in wall systems employing panels, especially of the concrete type, as the outer wythe thereof.

It is still another object of the present invention to provide an anchoring system of the foregoing type which is employed in wall systems employing stone masonry as the outer wythe thereof.

It is yet another object of the present invention to provide new and novel anchoring systems for use in the construction of wall systems employing wall reinforcing members in conjunction with novel wall-tie elements.

It is yet a further object of the present invention to provide new and novel wall-tie elements which are capable of both horizontal and lateral movement for use in the construction of anchoring systems employed in wall systems.

It is a more particular object of the present invention to provide wall-tie elements of new and improved construction which are capable of adjustable movement in the construction of wall systems to thereby facilitate the initial placement and securement purposes of said wall-tie elements and which members are thereafter positionally secured in firm securement in the wall systems to perform their ultimate function.

BRIEF DESCRIPTION OF THE DRAWINGS

The foregoing and other objects, features and advantages of the present invention will become readily apparent to those skilled in the art from a reading of the detailed description hereinafter, when considered in conjunction with the accompanying drawings, wherein.

DETAILED DESCRIPTION OF THE PREFERRED EMBODIMENTS

Figure 1:
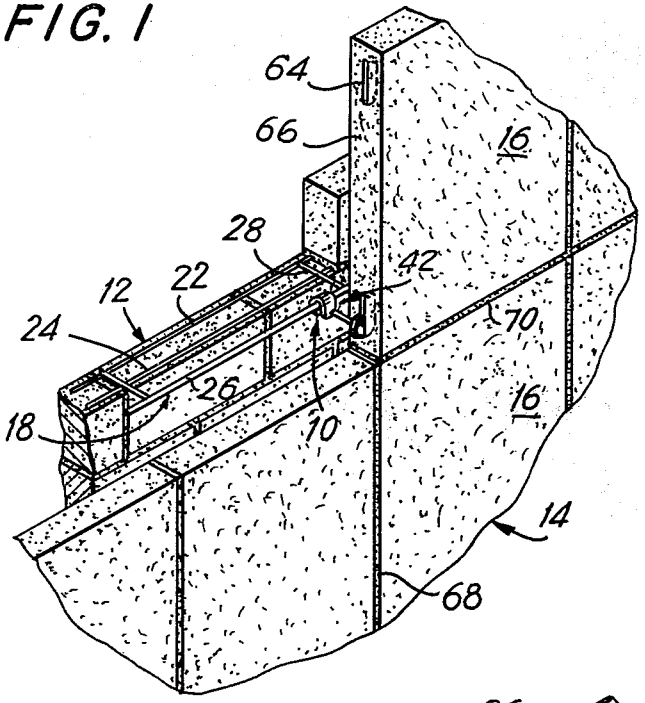
FIG. 1 is a perspective view of a first embodiment of a new anchoring system for use in the construction of a wall system comprising an inner wythe and an outer wythe.

Referring now to the drawings and, more particularly, to FIG. 1 thereof, there is shown a first embodiment of an anchoring system 10 constructed in accordance with the principles of the present invention and utilized in the construction of a wall system having an inner wythe 12 of block construction and an outer wythe 14 of concrete panel construction employing concrete panels 16.

The anchoring system 10 comprises a wall reinforcing assembly 18 and a wall-tie element, generally denoted by the reference numeral 42. The wall reinforcing assembly 18 comprises a pair of spaced parallel longitudinally extending reinforcing members 22 and 24, and a parallel longitudinally extending rod or member 26. The assembly 18 also includes a plurality of equally spaced laterally extending members 28 which serve to secure all of the members 22, 24 and 26 with respect to one another. The lateral members 28 have the inner ends 30 thereof secured to the members 22, intermediate points 32 thereof secured to the member 24 and the outer ends 34 thereof secured to the longitudinal member 26. The foregoing connections of the members 28 to the members 22, 24 and 26 may be by welding or by any other suitable means of structurally secure joinder.

The wall reinforcing assembly 18 is positionally disposed between succeeding courses of the inner wythe 12, such as course 36 and course 38 (FIG. 3) and is secured therein by means of mortar 40. The assembly 18 also serves to reinforce and strengthen the resultant inner wythe construction. With the assembly 18 positionally secured between adjacent succeeding courses 36 and 38 of the inner wythe 12, the longitudinal member 26 is positionally and fixedly positioned away from the exterior face of the inner wythe, as clearly depicted in FIGS. 2 and 3.

Figure 4:
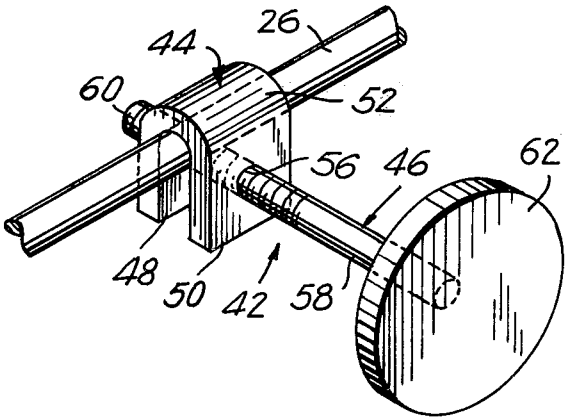
FIG. 4 is a perspective view of the new and novel wall-tie member employed in the anchoring system of FIG. 1.

A wall-tie element 42 comprising a U-shaped member 44 and a bolt member 46, is adapted to be connected to the longitudinally extending member 26 so as to secure the outer wythe 14 with respect to the inner wythe 12, in a manner to be described in detail hereinafter. The wall-tie element 42 is best illustrated in FIG. 4, wherein the securement thereof to the longitudinal member 26 is also clearly illustrated. The U-shaped member 44 has a substantially square configuration such that the length of the vertically extending arms 48 and 50 thereof are substantially equal to the width of the laterally base 52 thereof. It is to be noted that the actual physical dimensions of the element 42 are a matter of engineering consideration in dependence upon the particular system in which the same is employed, wherefore the dimensional relationships set forth hereinabove were derived at for use in conjunction with the first embodiment of the invention presently under discussion.

The vertically extending arms 48 and 50 are provided with threaded bores 54 and 56, respectively. The bores may be formed centrally within the arms 48 and 50 but are herein shown as being formed closer to the base 52. The positioning of the bores is partially dependent upon the thickness or diameter of the member 26, wherefore the positioning of the bores is as herein illustrated.

The bolt member 46 comprises a laterally extended bolt 58 having the outer end portion thereof threaded as at 60, and an enlarged inner end portion thereof in the form of a circular disc 62. The disc 62 may be formed integrally with the bolt 58 or may be welded thereto. Additionally, the disc 62 may be of rectilinear, oval or circular configuration, as will be more apparent hereinafter.

The wall-tie element 42 is initially positioned upon the longitudinal member 26 in the following very simple manner. The U-shaped member 44 and bolt member 46 are separated from one another and the U-shaped member 44 is then invertedly placed upon the member 26, as most clearly seen in FIGS. 3 and 4. The U-shaped member 44 is then cradled upon member 26, whereafter threaded end portion 60 of bolt member 46 is threadedly engaged, first in threaded bore 56 and then in threaded bore 54. After this has been accomplished, the wall-tie member 42 is positionally disposed with respect to the longitudinal member 26 but is capable of longitudinal slidable movement thereon, along that portion thereof disposed between successive adjacent lateral members 28 (FIG. 1.). Moreover, the wall-tie element 42 is capable of pivotal movement about the axis of longitudinal member 26 which results in limited vertical adjustability of the tie element. Additionally, the tie element 42 is capable of lateral adjustability by rotational movement thereof occasioned by the threaded engagement of end portion 60 with the bores 54 and 56. Thus, the wall-tie element 42 has three dimensional adjustability with regard to the longitudinal member 26; longitudinal slidable movement, vertical pivotal movement and lateral rotational movement.

Figure 2:
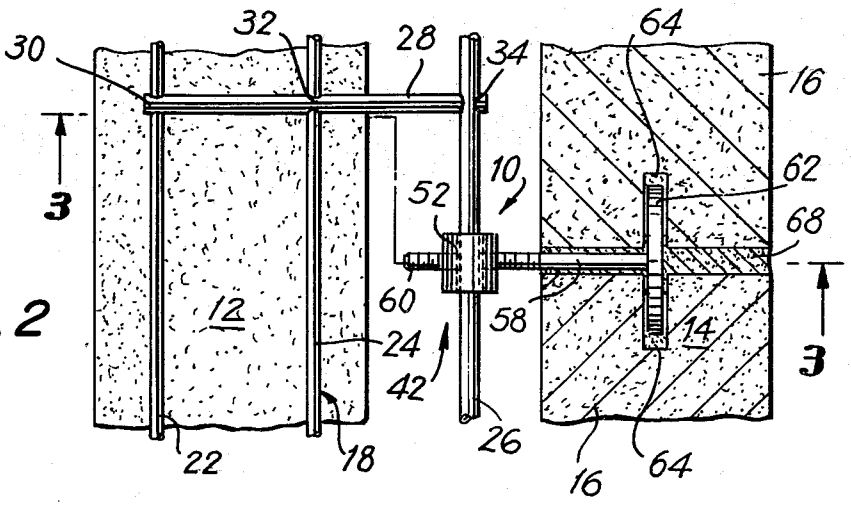
FIG. 2 is a partial top plan view of the wall and anchoring systems depicted in FIG. 1.
Figure 3:
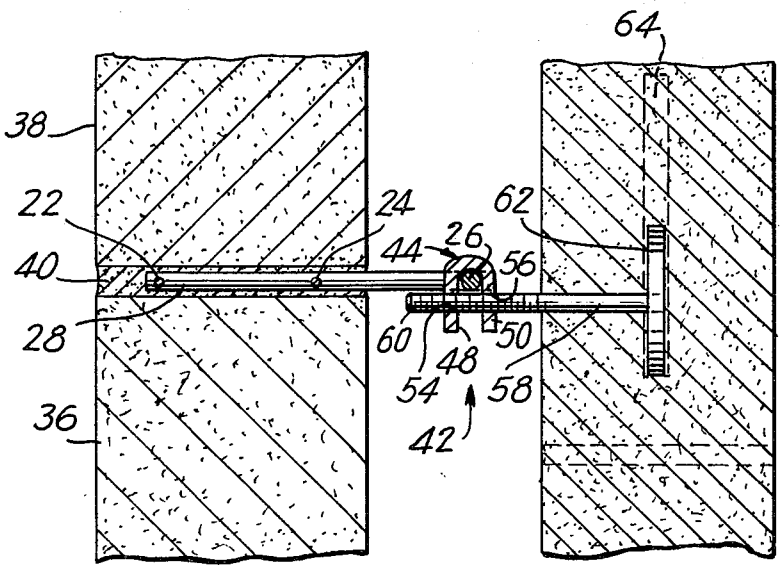
FIG. 3 is a sectional view taken on the line 3—3 of FIG. 2.

After the wall-tie element 42 has been initially positioned, as aforedescribed, the outer wythe is then positioned for securement to said tie element in the following manner. A concrete panel 16 is placed upon a previously secured concrete panel, as best seen in FIG. 1. The concrete panels 16 are provided with a pair of vertically oriented grooves or recesses 64 which may be of semi-circular, semi-elliptical or rectilinear configuration on the side 66 thereof. The panel 16 is held in place until the provided discs 62 of the respective wall-tie elements 42 are properly aligned and eventually inserted within the grooves 64. It is herein to be noted that only one-half of the disc 62 is insertable into each of the recesses 64. After two horizontally adjacent panels are secured in the manner specified, and as illustrated in FIG. 2, with vertical mortar joints 68 and horizontal mortar joints 70 being provided, the external holding apparatus for panels 16 may be removed. When two adjacent panels 16 are secured in this manner, the wall-tie element 42 is no longer capable of any further adjustment or movement and then serves its ultimate purpose of securing the outer wythe 14 with respect to the inner wythe 12 at a fixed predetermined distance therebetween.

It will be apparent to those skilled in the art that the wall system of the present invention provides an anchoring system wherein a longitudinal member is fixedly positioned between the inner and outer wythes of the wall system by means of a plurality of lateral members secured to the inner wythe. Thereafter, a three dimensionally adjustable wall-tie element is positionally secured to the longitudinal element and finally the outer wythe is secured to the wall-tie element and thus the inner wythe. It is to be noted that the adjustability and mobility of the wall-tie member 42 upon the longitudinal member 26 facilitates the effort required by the workmen for the ultimate positioning and securement of the outer wythe concrete panels 16.

It will be appreciated that although the present embodiment of the invention has been discussed with particular reference to concrete panels 16, the same may also be fabricated of stone or any other suitable type masonry material. Attention is also directed to the fact that the height of the individual courses of the inner wythe 12 may be substantially less than the height of the panels 16, whereby the reinforcing assembly 18 and wall-tie element 42 may not be utilized at every succeeding course, but also selected succeeding courses. However, it will be readily apparent to those skilled in the art, that other types of joinder of reinforcing means may be employed between those courses of the inner wythe 12 which do not correlate with corresponding ones of the courses of the outer wythe 14. In this regard, attention is also directed to the additional advantage of the present invention whereby it is not necessary to have vertical alignment of correlating courses of the inner and outer wythes since the pivotal movement of the tie element 42 about the longitudinal member 26 provides vertical adjustment of the disc 62 to enable the same to be aligned with the proper grooves 64 of the adjacently disposed panels 16, and due to the fact that the height of the grooves 64 is much greater than the diameter of discs 62.

Figure 6:
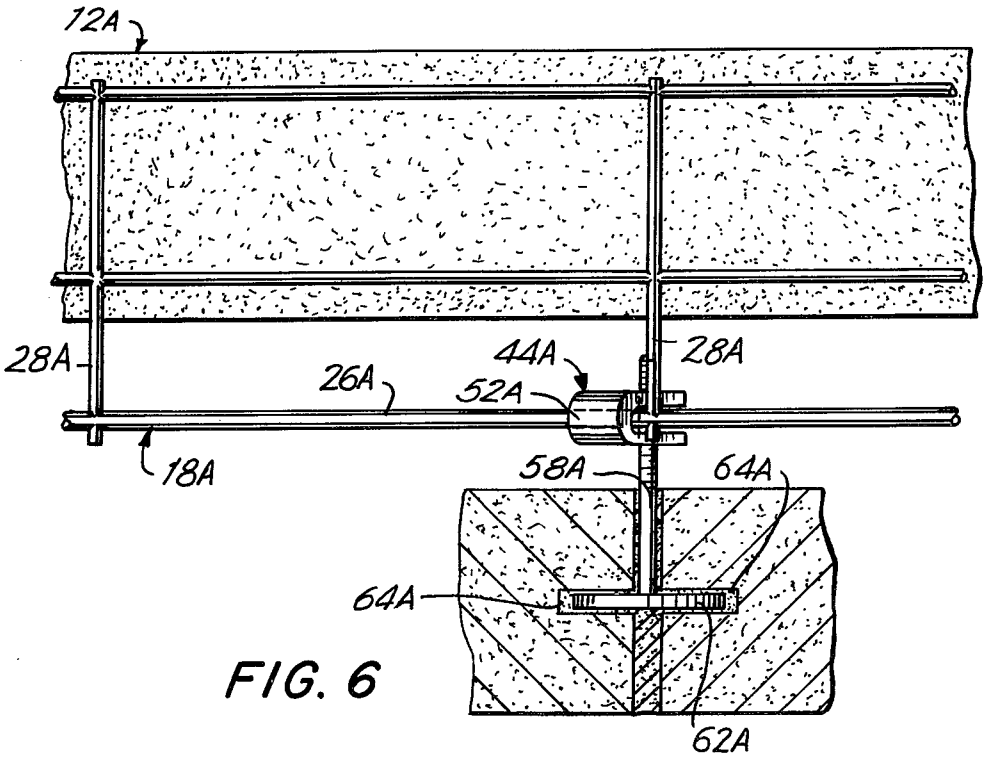
FIG. 6 is a plan sectional view taken on the line 6—6 of FIG. 5.
Figure 5:
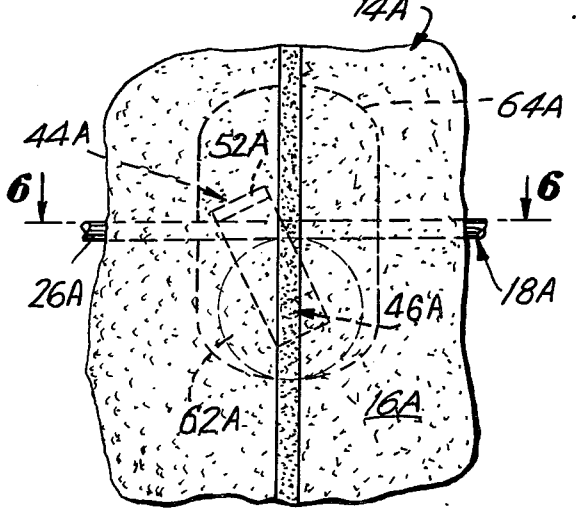
FIG. 5 is a partial front view of a second embodiment of an anchoring system of the present invention.
Figure 7:
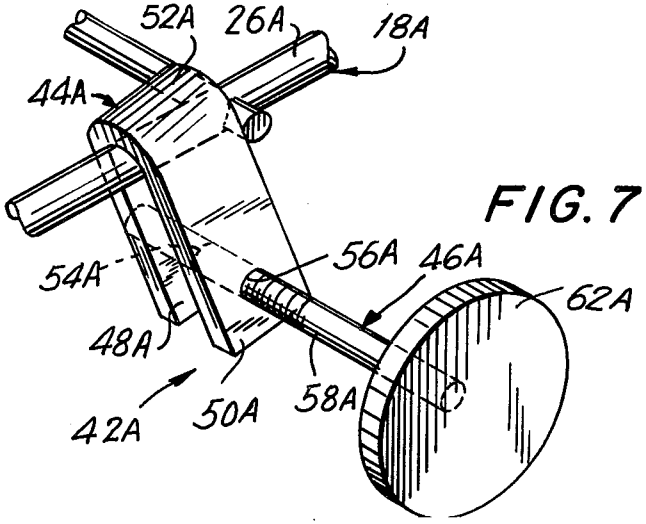
FIG. 7 is a perspective view of the new and novel wall-tie element which is employed in the anchoring system of FIG. 5.

A second embodiment of the present invention and, in particular, of the wall-tie element thereof, is illustrated in FIGS. 5 through 7, wherein similar parts are denoted by similar reference numerals. In this embobodiment, the wall-tie element 42A is constructed in a manner whereby the arms 48A and 50A of the U-shaped member 44A have a length which is approximately 2 to 3 times greater than the width of the laterally extending base portion 52A thereof. This structural configuration of the wall-tie element 42A is necessitated where the same is employed with a wall assembly 18A when it is required that the the wall-tie element be positionally secured at the joinder of the lateral member 28A and the longitudinal member 26A; i.e., when the lateral member 28A and the bolt member 46A are, of necessity, in vertical alignment. In this circumstance, the threaded bores 54A and 56A are formed in the lower portion of the arms 48A and 50A, respectively. Thus, the U-shaped member 44A and in particular the arms 48A and 50A have an appreciable pivotal length about the axis of the bolt 58A, thereby enabling the bolt 58A to be placed in vertical alignment with lateral member 28A, so as to accommodate the required positional securement of adjacent panels 16A and thus the positioning of the disc 62A in the adjacent grooves 64A. In this regard, attention is directed to the fact that the height of grooves 64A is substantially greater than the diameter or other longest dimension of the disc 62A to permit the required nesting engagement even when the height variation between the plane of the assembly 18A and the axis of bolt 58A is appreciable.

Figure 9:
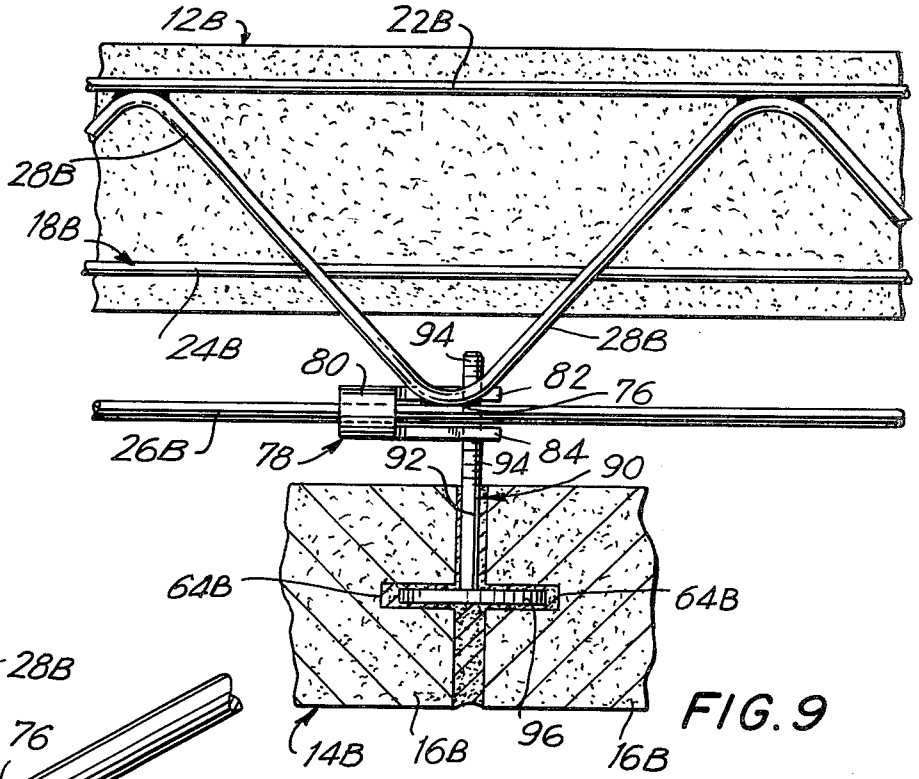
FIG. 9 is a plan sectional view taken on the line 9—9 of FIG. 8.
Figure 10:
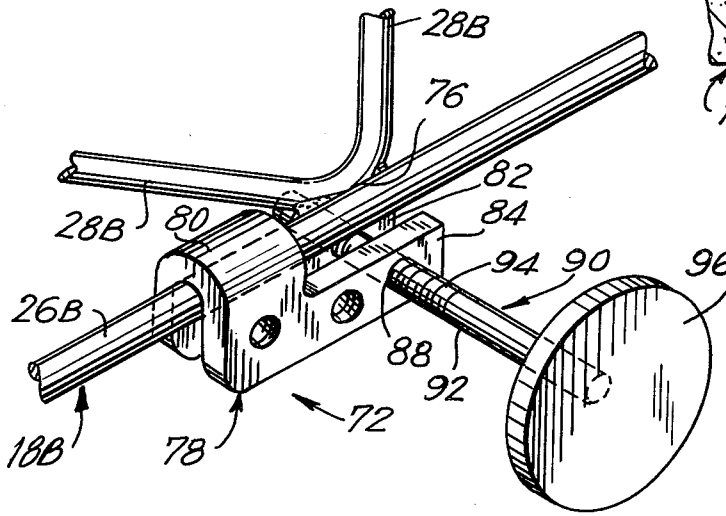
FIG. 10 is a perspective view of the new and novel wall-tie element which is employed in the anchoring system of FIG. 8.
Figure 8:
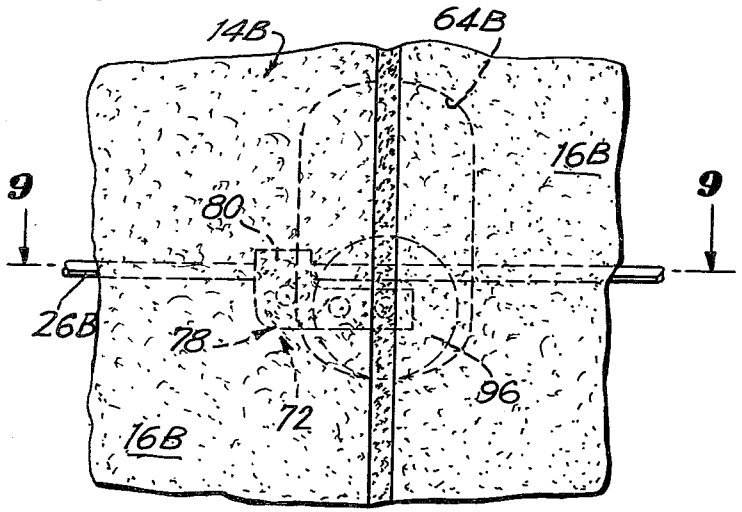
FIG. 8 is a partial front view of a third embodiment of an anchoring system of the present invention.

With reference now to FIGS. 8 through 10, there is illustrated a third embodiment of the present invention depicting a wall-tie element generally denoted by the reference numeral 72, and, wherein similar parts are denoted by similar reference numerals. The wall-tie element is of a construction which permits its use in those types of systems and oreintations of the inner and outer wythes, hereinbefore described in conjunction with FIGS. 1 through 7; the first and second embodiments of the present invention. In the present embodiment, the wall reinforcing assembly 18B includes lateral members 28B which are angularly inclined and connected to one another as well as members 22B, 24B and longitudinal member 26B, in a manner such that the same is characterized as repeptitious triangular or sawtooth configuration secured between the member 22B and member 26B. The outer apex of members 28B is secured to member 26B and is denoted by the reference numeral 76, as best seen in FIG. 10.

The wall-tie element 72 comprises a U-shaped member 78 having a base 80 and a pair of L-shaped arms 82 and 84. The arms 82 and 84 are provided with a plurality of horizontally disposed threaded bores 86 and 88, respectively. The axes of the bores 86 in arm 82 may be disposed in either planar or non-planar relationship. Similarly, the bores 88 in arm 84 may be disposed in planar or non-planar relationship; provided however, that corresponding ones of the bores 86 and 88 are disposed in coaxial relationship.

The wall-tie element 72 is also capable of three dimensional adjustability and includes a bolt member 90 which comprises a laterally extending bolt 92 having a threaded outer end portion 94 and an enlarged inner end portion 96, which in the illustrated form of the invention is of circular disc configuration. However, as discussed hereinbefore, the inner end portion may be of elliptical, rectilinear, circular or any other suitable configuration.

When the ultimate positional disposition of the wall-tie element 72 upon longitudinal member 26B is not at the apex 76, the threaded end portion 94 of bolt member 90 may be threadedly engaged in any corresponding pair of the coaxially disposed threaded bores 86, 88 in arms 82, 84; respectively. However, as depicted in FIGS. 9 and 10, when it is required that the bolt 92 be aligned with the apex 76 or otherwise disposed in substantially horizontal alignment with a lateral member 28B, it is necessary to have the threaded end portion 94 threadedly engage the coaxial pair of bores in the horizontally disposed portion of the L-shaped arms 82 and 84. In this manner, the base portion 80 which is required to be positioned upon member 26B is capable thereof by being displaced horizontally to one side of apex 76, while simultaneously permitting the axis of bolt 92 to be dispoed in horizontal alignment with apex 76 but vertically offset with respect thereto. In this configuration the disc 96 may then be seated within the adjacent grooves 64B in panels 16B, as necesitated by the placement of the concrete panels. It is to be noted that the arcuate interior contour of base 80 seated upon the rounded longitudinal member 26B results in secure engagement of the wall-tie element 72 to rod 26B, of outer wythe 14B to assembly 18B, and thus, of the outer wythe 14B to the inner wythe 12B.

It is herein to be noted that although in the present and previously discussed embodiments, the concrete panels have been described as having a plurality of vertically oriented and spaced grooves (64, 64A and 64B), it is within the realm and teachings of the present invention to provide the panels with a singular groove which extends vertically along the entire height of the panel. In this instance, it is preferable that the enlarged end portions (62, 62A and 96) be formed of square or rectangular configuration.

Figure 11:
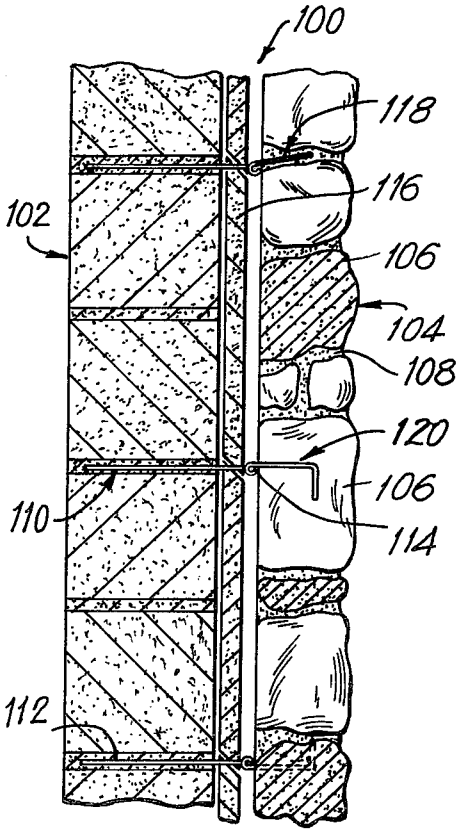
FIG. 11 is a side elevational view of an anchoring system employed in the construction of a wall system having a stone masonry outer wythe.

With reference now to FIG. 11, there is illustrated a new wall system employing a stone masonry outer wythe, and wherein the wall system is generally denoted by the reference numeral 100. The system 100 comprises an inner wythe 102 of block construction and an outer wythe 104 of stone construction, with the outer wythe being built with irregular geometrically shaped stones 106 disposed in adjacently disposed relationship and being secured by means of mortar therebetween generally indicated by the reference numeral 108. A wall reinforcing assembly 110 of the same construction as assembly 18 (FIGS. 1 through 4) is secured between alternate successive courses of the inner wythe 102. The assembly 110 includes lateral members 112 and longitudinally disposed member 114. Secured between vertically adjacent courses of the assemblies 110 is a waterproof insulation system employing insulating members 116. The insulating members 116 and, more generally, the insulating system is of the type discussed in my previously issued U.S. Pat. No. 3,772,840 entitled Insulating and Waterproofing Apparatus, System and Method; and my U.S. Pat. No. 3,812,635 entitled Method of Constructing Insulating and Waterproofing Assembly.

Figure 12:
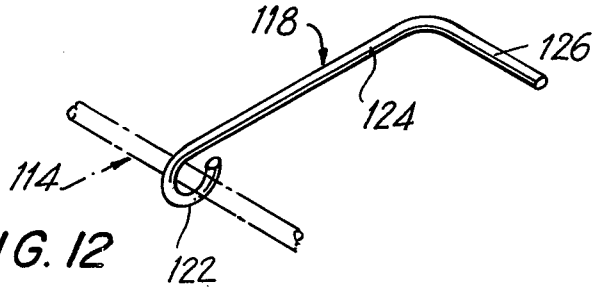
FIG. 12 is a perspective view of a new wall-tie element employed in the anchoring system of FIG. 11.

The wall system includes a first wall-tie element 118 (FIG. 12) and a second wall-tie element 120. The wall-tie element 118 comprises an outer end portion 122 having a helical configuration, a laterally disposed rod-like body portion 124 and an angularly disposed inner end portion 126; the outer end portion 126 being substantially perpendicular to the body portion 124. The helical outer end portion 122 and body portion 124 are disposed in substantially coplanar relationship and the inner end portion 126 is disposed in a plane substantially perpendicular to the plane of the helical portion 122 and body portion 124.

The wall-tie element 120 also includes a helical outer end portion 132, a rod-like body portion 134 and an angularly disposed inner end portion 136. However, in this wall-tie element, although the end portion 136 is also disposed substantially perpendicular to the body portion 134, the entire wall-tie element 120 comprising the helical outer end portion 132, the body portion 134 and the inner end portion 136 are disposed in substantially coplanar relationship.

Figure 14:
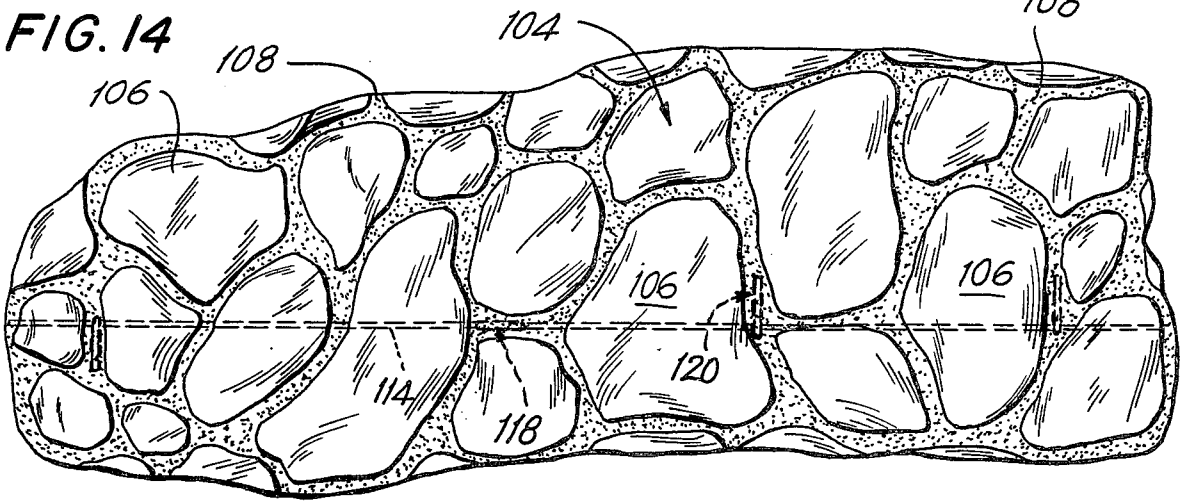
FIG. 14 is a front elevational view of the wall and anchoring systems depicted in FIG. 11.

In the construction of the wall assembly 100, the inner wythe 102 is constructed first having the wall assemblies 110 secured therein, as shown in FIG. 11. As the stones 106 are laid in place, the type of wall-tie required is selected in dependence upon the configuration of adjacent ones of the stones. In this regard, and with particular reference to FIG. 14, it will be readily apparent that when a substantially horizontal joint is presented, the wall-tie 118 is employed, and when a substantially vertical joint is presented, the wall-tie 120 is utilized. In this manner, a stone mason need not concern himself with whether he must arrange the stones to provide solely horizontal or solely vertical joints.

The ties 118 and 120 are secured to the longitudinal member 114 by engaging the same in the helical end portions 122 or 132, whereupon the wall-ties 118 and 120 are horizontally adjustable by means of slidable movement thereof upon the longitudinal member 114. Moreover, the wall-ties are vertically adjustable by means of the pivotal movement thereof about the longitudinal member. However, there is virtually no possible lateral movement of the ties 118 and 120 with respect to member 114 after the initial securement of the ties in the mortar 108. Thus, there is no possible lateral movement of the outer wythe 104 with respect to the inner wythe 102.

Figure 15:
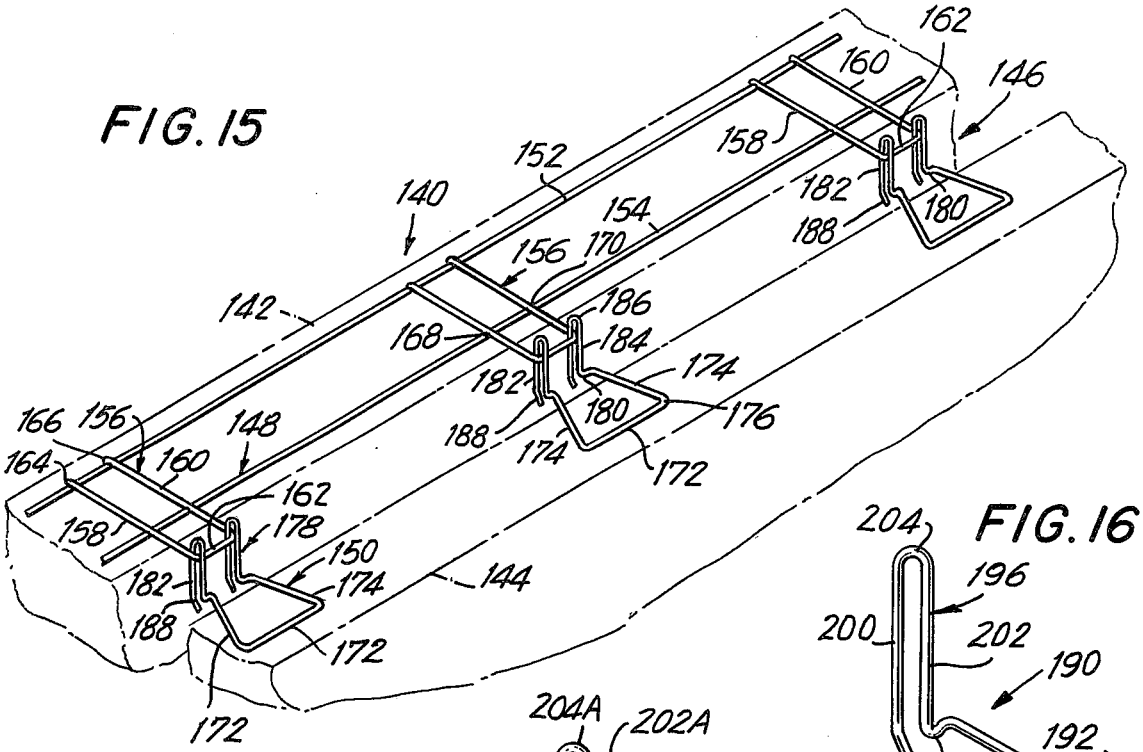
FIG. 15 is a perspective view of another new and novel wall-tie element.

Referring now to FIG. 15, there is shown another embodiment of an anchoring system constructed pursuant to the present invention. In this embodiment, a wall system 140 comprises an inner wythe 142 and an outer wythe 144. The anchoring system 146 comprises a wall reinforcing assembly 148 and a wall-tie element 150. The wall reinforcing assembly 148 comprises a pair of spaced parallel longitudinally extending reinforcing rods 152 and 154 and a plurality of equally spaced laterally extending U-shaped members 156. The members 156 comprise arms 158, 160 and base portion 162. The inner ends 164 and 166 of the arms 158 and 160, respectively, are secured to the member 152, while intermediate portions of the arms 158 and 160 are secured to the member 154 at 168 and 170, respectively. The members 156 are preferably secured to the members 152 and 154, as aforedescribed, by welding. The wall reinforcing assembly 148 is built into and serves to reinforce the inner wythe 142 by being positionally secured between selected successive courses of said inner wythe.

The wall-tie element 150 comprises a longitudinal rod 172 having substantially lateral rods 174 secured thereto so as to form a partial triangular configuration. The lateral rods 174 have the inner ends 176 thereof secured to the ends of rod 172, by being formed integrally therewith. The outer ends of the lateral rods 174 are terminated in a U-shaped end portion 178 extending upwardly therefrom. Disposed between the end portion 178 and the rod 174 is a downwardly extending protuberance 180 which serves as a drip member which assists in directing any water appearing in the space between the inner wythe 142 and the outer wythe 144, downwardly in said space and away from the inner wythe 142.

The U-shaped end portion 178 includes arms 182 and 184 and an arcuate base 186. The space between arms 182 and 184 is just slightly greater than the thickness of the base 162 of the U-shaped member 156, the purpose of which will be explained in detail hereinafter.

The wall-tie element 150 is positionally secured between selected successive courses of the outer wythe 144. When it is desired to secure the wythe 144 to wythe 142, and the selected course of inner wythe 142 is at a raised elevation with respect to the corresponding course of the outer wythe 144, the upwardly extending end portions 178 are able to be placed or fitted upon the base 162, to thereby secure assembly 148 with element 150. As described hereinbefore, the space between arms 182 and 184 is just slightly larger than the thickness of base 162 enabling the end portions 178 to securely engage base 162 and to effectuate a laterally immovable locking engagement therebetween.

In the event the joinder of courses of said inner and outer wythes are coplanar, the engagement will be as above described. However, if the joinder of courses of the outer wythe 144 is at a raised elevation with respect to the joinder of courses of said inner wythe 142, then to obtain the proper securement of end portions 178 with base 162, it is necessary to turn the entire element 150 upside down. In this position, the end portions 178 would extend downwardly from the lateral rods 174 but the immovable locking engagement would occur, as previously. Thus, the laterally immovable locking engagement of assembly 148 with element 150 prevents lateral movement of the inner wythe 142 with respect to the outer weythe 144.

Attention is directed to the U-shaped end portions 178, and more particularly, the free arms 182, which are provided with projecting members or tips 188 which extend rearwardly towards the lateral rods 174. The tips 188 serve to facilitate the initial securement of the wall-tie reinforcing element to the wall reinforcing assembly. This is accomplished by the ease of which the tip 188 engages the base 162. Thereafter, the end portions 178 can be pushed down upon the base 162 securing the same within the space between the arms 158 and 160 of the U-shaped end portions 156.

Figure 16:
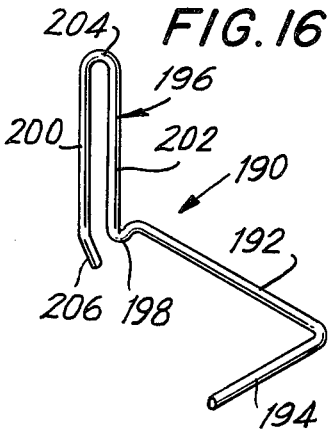
FIG. 16 is a perspective view of another new and novel wll-tie element.

FIG. 16 depicts a wall-tie element 190 which may be employed in conjunction with the wall system of FIG. 15 or with the embodiments of the wall systems described hereinbefore. The wall-tie element comprises lateral rod 192 and an angularly inclined inner end portion 194 disposed substantially perpendicular thereto. The outer end of rod 192 is terminated in a U-shaped end portion 196, extending upwardly therefrom. Disposed between the end portion 196 and the rod 192 is a downwardly extending protuberance 198 whose purpose and function have previously been set forth in conjunction with the discussion of FIG. 15.

The U-shaped end portion 196 comprises arms 200 and 202 and an arcuate base portion 204. The free arm 200 includes an integrally formed rearwardly extending tip 206 which facilitates the initial securement of the wall-tie element 190 with a coacting assembly or member, as discussed hereinabove.

Figure 17:
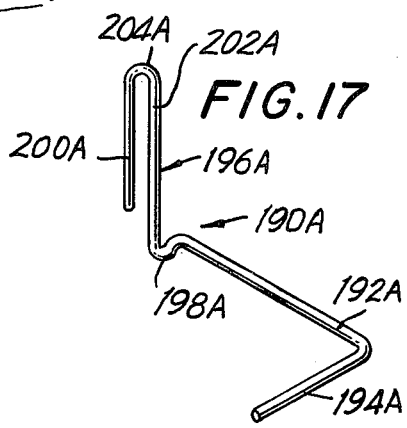
FIG. 17 is a perspective view of yet another new and novel wall-tie element.

With reference to FIG. 17, there is depicted a wall-tie element 190A similar in construction and purpose to the element 190 of FIG. 16, and wherein similar parts are denoted by similar reference numerals. The wall-tie element 190A comprises a lateral rod 192A, a perpendicularly disposed inner end portion 194A, a U-shaped outer end portion 196A having arms 200A, 202A and an arcuate base portion 204A; and a protuberance 198A. However, in element 190A, the free arm 200A is shorter than arm 202A.

Figure 18:
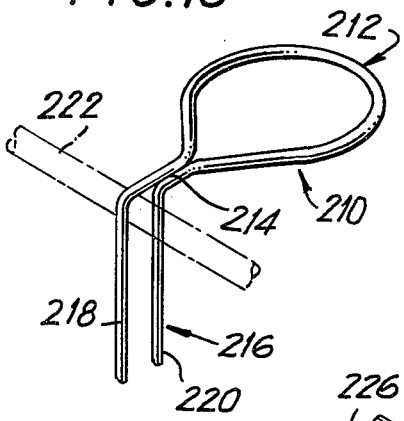
FIG. 18 is a perspective view of still a further new and novel wall-tie element.

FIG. 18 depicts another type of wall-tie element 210 for use in conjunction with the wall systems of the present invention. The wall-tie element 210 comprises a looped inner end portion 212 which closes upon itself and abuts to form a lateral body portion 214 and which thereafter extends downwardly from said body portion to form a bifurcated outer end portion 216 comprised of spaced rod members 218 and 220. The bifurcated outer end portion is adapted to engage a longitudinal rod member of a reinforcing wall assembly, as aforedescribed, shown in phantom and designated 222, by positioning the member 222 between the rods 218 and 220, as shown.

Figure 19:
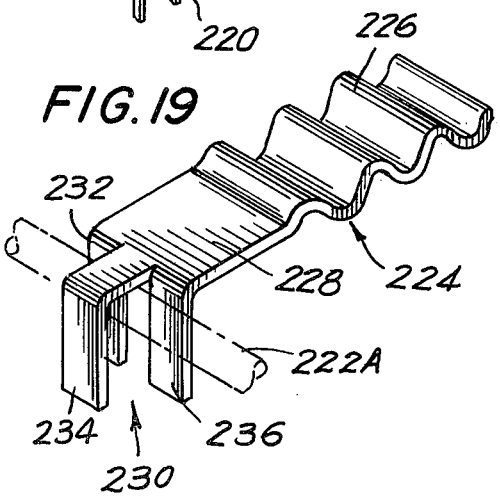
FIG. 19 is a perspective view of a further wall-tie element.

Another wall-tie element 224 is shown in FIG. 19 and comprises a corrugated inner end portion 226, a lateral substantially flat body portion 228 which terminates in a trifurcated downwardly extending outer portion 230 comprising fingers 232, 234 and 236, with the fingers 232 and 236 being disposed in coplanar relationship. The finger 234 projects beyond fingers 232 and 236, whereby the fingers are adapted to engage the phantomly illustrated longitudinal member 222A.

Figure 13:
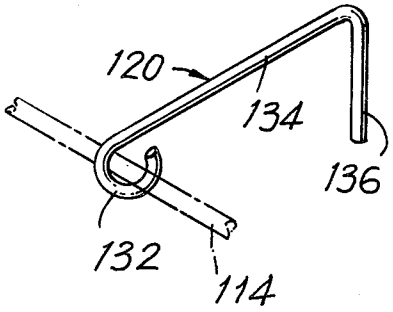
FIG. 13 is a perspective view of another new wall-tie element employed in the anchoring system of FIG. 11.
Figure 20:
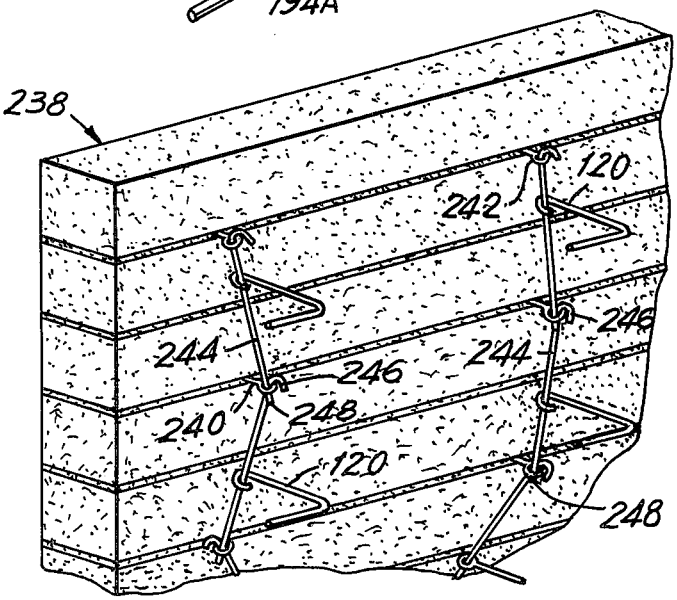
FIG. 20 is a perspective view of the inner wythe of a wall system depicting another anchoring system of the present invention.
Figure 22:
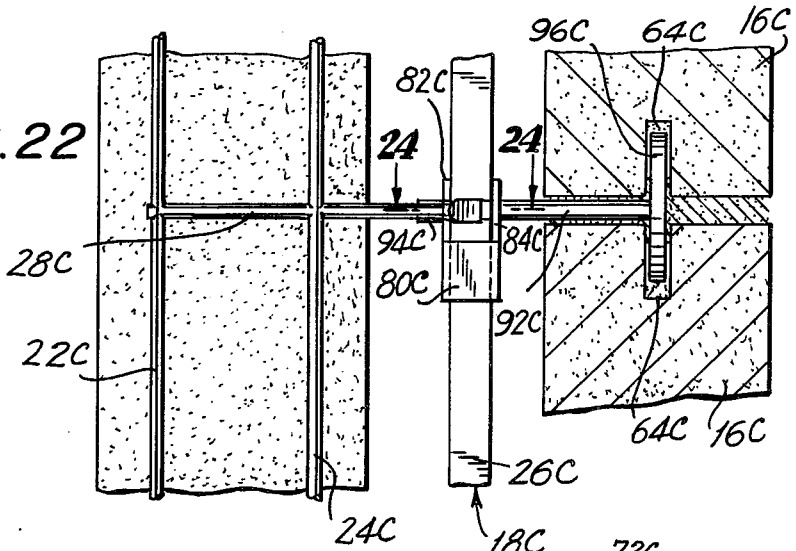
FIG. 22 is a top plan view of the wall and anchoring systems depicted in FIG. 21.
Figure 24:
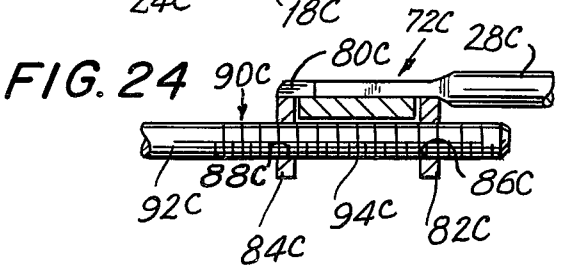
FIG. 24 is a sectional view taken on the line 24—24 of FIG. 22.

FIG. 20 depicts the inner wythe 238 of a wall system wherein it is desired to provide vertical and horizontal adjustment for wall-tie elements and specifically employing the novel wall-tie element 120 depicted in FIG. 13. The inner wythe 238 is provided with lateral members 240 which terminate in eyelets or closed loops 242 and which members 240 are positioned in selected courses of the inner wythe in vertically non-aligned relationship. Vertical rods 244 having arcuate upper end portions 246 are positioned in vertically adjacent eyelets 242 so as to be disposed in vertically skew relationship. The arcuate upper end portion 246 of one rod 244 is positioned in the same eyelet 242 as the lower end 248 of the next higher rod 244. There is thus provided a multiplicity of angularly inclined rods in the space between the inner and other wythes of the wall system which, in conjunction with the slidable wall-tie elements 120, provide an anchoring system having both vertical and horizontal adjustability but which prohibits any lateral movement of the outer wythe with respect to the inner wythe.

Referring now to FIGS. 21 through 24, there is depicted another embodiment of an anchoring system formulated in accordance with the principles of the present invention and similar to the embodiment shown by FIGS. 8 through 10, wherefore similar parts are illustrated by similar reference numerals.

The anchoring system 10C comprises a wall reinforcing assembly 18C comprising a pair of spaced parallel longitudinally extending reinforcing rods 22C and 24C, which may be of circular or rectilinear cross-section, and a parallel longitudinally extending elongated rod or member 26C of rectangular cross-section. The assembly 18C also includes a plurality of equally spaced lateral members 28C which may be of circular or rectilinear cross-sectional configuration.

A wall-tie element 72C is of U-shaped channel construction having a flat base 80C and a pair of L-shaped arms 82C and 84C which arms are provided with pairs of horizontally disposed threaded bores 86C and 88C, respectively, with corresponding ones of the bores 86C and 88C being disposed in coaxial alignment.

The wall-tie element 72C includes a bolt member 90C comprising a laterally extending bolt 92C having a threaded outer end portion 94C and an enlarged inner end portion 96C, herein depicted as being of circular configuration. When the intersection of lateral member 28C and longitudinal member 26C requires a wall-tie element 72C to be secured thereat due to the required placement of concrete panels 16C, it is necessary to have the threaded end portion 94C threadedly engage the coaxial pair of bores 86C, 88C in the horizontally disposed portion of the L-shaped arms 82C, 84C; respectively. When the wall-tie element 72C is secured in this manner, the base portion 80C is displaced to one side of the intersection of members 26C and 28C, while permitting the bolt 92C and member 28C to be in vertically displaced coaxial alignment. This structure then complies with the requirement of seating the disc 96C within the adjacent grooves 64C of the concrete panels 16C, as dictated by the necessary positional placement of the concrete panels.

Figure 25:
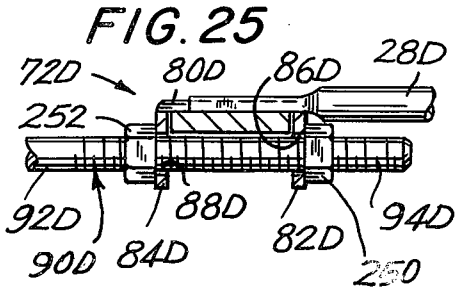
FIG. 25 is a sectional view similar to FIG. 24 depicting another embodiment of a new and novel wall-tie element of the present invention.
Figure 21:
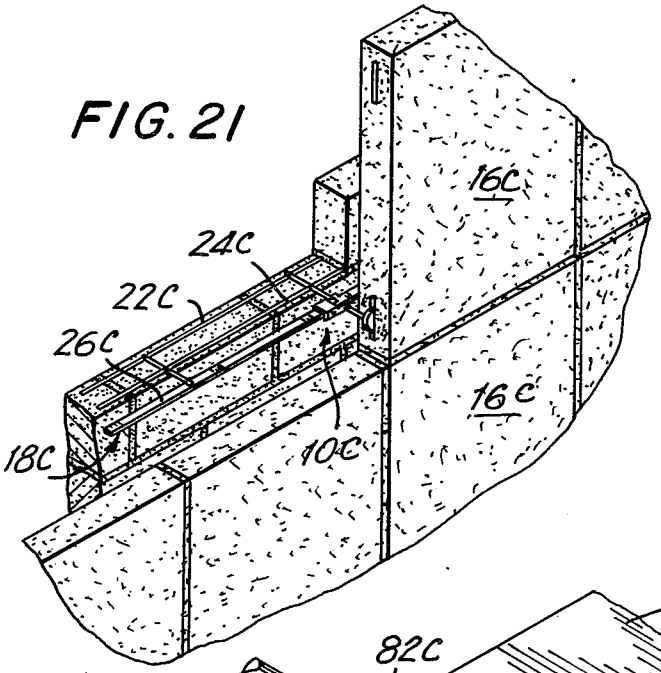
FIG. 21 is a perspective view of another embodiment of an anchoring system of the present invention for use in the construction of a wall system comprising an inner wythe and an outer wythe.
Figure 23:
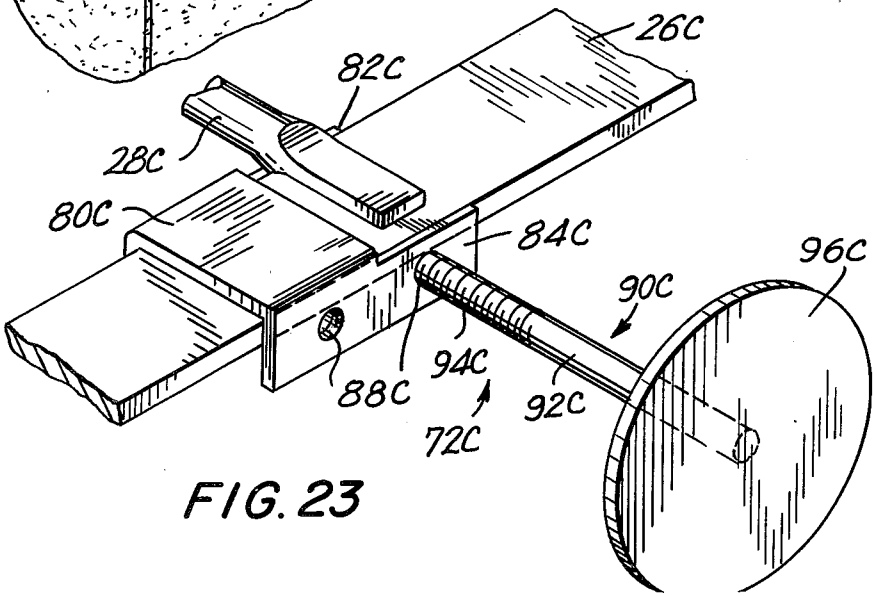
FIG. 23 is a perspective view of the new and novel wall-tie element employed in the anchoring system of FIG. 21.

A final embodiment of a U-shaped channel construction wall-tie element is depicted in FIG. 25 wherein similar parts are denoted by similar reference numerals. In this embodiment, the wall-tie element 72D comprises a flat base 80D, arms 82D and 84D. The bolt member 90D is of identical configuration as member 90C. However, the bores 86D and 88D formed in the arms 82D and 84D, respectively, are not threaded. Thus, the threaded outer end portion 94D merely protrudes through the bores 86D and 88D. The desired lateral positioning of bolt member 90D is obtained by a pair of nuts 250 and 252 which threadedly engage end portion 94D and which are ultimately positioned in abutting engagement with the external flat surfaces of arms 82D and 84D, respectively.

It is herein to be understood that the terminology "inner end" and "outer end" have a specific connotation as used in the present application. Accordingly, the term "inner end" as employed herein is used to denote that end of an element, member or assembly which is secured within either the inner or outer wythe of a wall assembly, while the term "outer end" is used to denote that end of an element, member or assembly which is positionally disposed in the space between the inner and outer wythes of a wall assembly.

The term "fixed adjustable securement" is deemed to mean the initial adjustable positioning of the wall-tie elements adn the subsequent fixed interconnection of the inner wythe to the outer wythe by virtue of the wall-tie reinforcing assembly and components thereof in conjunction with the wall-tie elements and its components.

It is to be noted that although I have shown, described and claimed concrete panels, the term "concrete panels" is also intended to include stone panels, brick panels and other masonry panels.

While I have shown and described the various preferred embodiments of the present invention, it will be appreciated that the teachings herein will readily lend itself to many modifications, changes, combinations and improvements by those skilled in the art, without deviation from the present invention or the teachings hereof.

What is claimed is:

1. An anchoring apparatus for use in the construction of wall structures having an inner wythe and an outer wythe in spaced apart relationship and comprising a longitudinal member, a multiplicity of lateral members each having one of the ends thereof secured to one of said inner and outer wythes and each having the other end thereof fixedly secured to said longitudinal member fixedly securing said longitudinal member in the space between said wythes, a wall-tie element having connecting means on the outer end thereof providing fixed adjustable securement of said wall-tie element to said longitudinal member, and said wall-tie element having connecting means on the inner end thereof providing securement of said inner end to the other of said inner and outer wythes.

2. An anchoring apparatus in accordance with claim 1, wherein said multiplicity of lateral members are disposed in spaced apart parallel relationship, and said wall-tie element is adjustably secured to that portion of said elongated longitudinal member disposed between two adjacent ones of said lateral members.

3. An anchoring apparatus in accordance with claim 2, wherein said longitudinal member is positionally secured to said inner wythe.

4. An anchoring apparatus in accordance with claim 3, wherein said wall-tie element includes means providing lateral adjustment thereof between said inner and outer wythes.

5. An anchoring apparatus for use in the construction of wall structures having an inner wythe and an outer wythe in spaced apart relationship and comprising a wall reinforcing assembly, and a wall-tie element, means securing said wall reinforcing assembly with respect to one of said inner and outer wythes, means securing said wall-tie element with respect to the other of said inner and outer wythes, said wall reinforcing assembly comprising at least two spaced parallel longitudinally extending members, and a plurality of members each of which extends laterally between and is attachingly secured to said parallel members, one of said longitudinal members being secured with respect to said one of said wythes, the other of said longitudinal members being fixedly secured in the space between said wythes, said wall-tie element being laterally disposed between said other of said longitudinal members and said other of said wythes, said wall-tie element having connecting means at the outer end thereof providing adjustable locking engagement thereof with the other of said longitudinal members, and said wall-tie element having securement means at the inner end thereof providing securement of said inner end to the other of said wythes.

6. An anchoring apparatus in accordance with claim 5, wherein said wall-tie element is capable of horizontal adjustable movement in the space between adjacent ones of said lateral members, and said wall-tie element is capable of horizontal adjustable movement in the space between adjacent ones of said lateral members, and said wall-tie element is capable of lateral adjustable movement between said other of said longitudinal members and said other of said wythes.

7. An anchoring apparatus in accordance with claim 5, wherein said wall-tie element is capable of horizontal adjustable movement in the space between adjacent ones of said lateral members, and said wall-tie element is capable of pivotal vertical adjustability about the axis of said other of said longitudinal members.

8. An anchoring apparatus in accordance with claim 6, wherein said wall-tie element is capable of horizontal adjustable movement in the space between adjacent ones of said lateral element, and said wall-tie member is capable of pivotal vertical adjustability about the axis of said other of said longitudinal members, thereby providing a wall-tie element having three dimensional adjustability in the space between said inner and outer wythes.

9. An anchoring apparatus in accordance with claim 5, wherein said one of said wythes is the inner wythe, and said other of said wythes is the outer wythe.

10. An anchoring appartus in accordance with claim 5, wherein said wall reinforcing assembly comprises three spaced parallel longitudinally extending members, two of said longitudinal members being secured within said one of said wythes, and said laterally extending member being attachingly secured to at least one of said two longitudinal members and to the other of said longitudinal members.

11. An anchoring apparatus in accordance with claim 10, wherein said wall-tie element is capable of horizontal adjustable movement in the space between adjacent ones of said lateral members, and said wall-tie element is capable of lateral adjustable movement between said other of said longitudinal members and said other of said wythes.

12. An anchoring apparatus in accordance with claim 10, wherein said wall-tie element is capable of horizontal adjustable movement in the space between adjacent ones of said lateral members, and said wall-tie element is capable of pivotal vertical adjustability about the axis of said other of said longitudinal members.

13. An anchoring apparatus in accordance witih claim 11, wherein said wall-tie element is capable of horizontal adjustable movement in the space between adjacent ones of said lateral members, and said wall-tie element is capable of pivotal vertical adjustability about the axis of said other of said longitudinal members, thereby providing a wall-tie element having three dimensional adjustability in the space between said inner and outer wythes.

14. An anchoring appartus in accordance with claim 10, wherein said one of said wythes is the inner wythe, and said other of said wythes is the outer wythe.

15. An anchoring apparatus in accordance with claim 10, wherein said other of said wythes is the outer wythe which comprises a concrete panel construction wherein the panels are positioned in adjacently disposed side by side relationship, each of said panels having at least one vertically disposed groove formed in each of the sides thereof, said grooves in the sides of adjacent ones of said panels being disposed in lateral alignment, said inner end of said wall-tie element including an enlarged end portion capable to being seatedly positioned within said adjacently disposed grooves for securement of said wall-tie element to a pair of adjacent concrete panels.

16. An anchoring apparatus in accordance with claim 10, wherein said wall-tie element comprises a U-shaped member, and a bolt member, said U-shaped member comprising a base portion, and a pair of arms, said arms being secured to said base portion and having a pair of coaxially aligned bores formed therein, said bores being disposed in laterally offset relationship with respect to one another, said bolt member including a laterally extending bolt having a threaded outer end portion, said base portion being positioned upon said other of said longitudinal members, at least one of said arms including threaded engagement means associated therewith, and said threaded outer end portion of said bolt passing through said coaxially aligned bores and being positionally disposed therethrough by threaded securement of said threaded outer end portion by said threaded engagement means.

17. An anchoring apparatus in accordance with claim 16, wherein said U-shaped member is of channel construction having the base thereof disposed in a plane which is mutually perpendicular to the planes of the arms thereof.

18. An anchoring appartus in accordance with claim 17, wherein said other of said longitudinal members is of rectilinear cross-section.

19. An anchoring apparatus in accordance with claim 16, wherein said threaded engagement means associated with said one of said arms comprises the internal threading of said bore formed in said one of said arms.

20. An anchoring apparatus in accordance with claim 16, wherein said threaded engagement means comprises a pair of nuts positionally disposed on either side of said arms on the exterior surface thereof and threadedly engaging the threaded outer end portion of said bolt.

21. An anchoring apparatus in accordance with claim 19, wherein each of said bores is internally threaded for engagement with the threaded outer end portion of said bolt.

22. An anchoring apparatus in accordance with claim 16, wherein said bolt member includes an enlarged inner end portion for securing the inner end of said wall-tie element to said other of said wythes.

23. An anchoring apparatus in accordance with claim 22, wherein said enlarged bolt member inner end portion comprises a disc member.

24. An anchoring apparatus in accordance with claim 23, wherein said disc member is of circular configuration.

25. An anchoring apparatus in accordance with claim 21, wherein said bolt member has an enlarged circular disc inner end portion for securing said wall-tie element to said other of said wythes.

26. An anchoring apparatus in accordance with claim 25, wherein said one of said wythes is the inner wythe, and said other of said wythes is the outer wythe.

27. An anchoring apparatus in accordance with claim 26, wherein said outer wythe comprises a concrete panel construction wherein the panels are positioned in adjacently disposed side by side relationship, each of said panels having at least one vertically disposed groove formed in each of the sides thereof, said grooves in the sides of adjacent one of said panels being disposed in lateral alignment, and said circular disc end portion is seated within adjacently disposed grooves for securement of said wall-tie member to adjacent ones of said concrete panels.

28. An anchoring apparatus in accordance with claim 16, wherein the height of said arms is substantially equal to the width of the base portion of said U-shaped member.

29. An anchoring apparatus in accordance with claim 16, wherein the height of said arms is equal to between two to three times the width of the base portion of said U-shaped member.

30. An anchoring apparatus in accordance with claim 16, wherein each of said arms of said U-shaped member have an L-shaped configuration, the horizontally disposed portions of each of said L-shaped arms having a plurality of substantially horizontally aligned bores formed therein, corresponding ones of the bores in each of the arms being disposed in coaxial alignment, and said bolt member being capable of threaded engagement within a selected one of said coaxial pairs of bores.

31. An anchoring apparatus in accordance with claim 30, wherein said U-shaped member is of channel construction having the base thereof disposed in a plane which is mutually perpendicular to the planes of said L-shaped arms.

32. An anchoring apparatus in accordance with claim 31, wherein said other end of said longitudinal members is of rectilinear cross-section.

33. An anchoring apparatus in accordancw with claim 31, wherein said threaded engagement means comprises a pair of nuts positionally disposed on either side of said arms on the exterior surface thereof and threadedly engaging the threaded outer end portion of said bolt, and the axis of said bolt being coaxial with said selected pair of bores and said nuts.

34. An anchoring apparatus in accordance with claim 30, wherein said bolt member includes an enlarged inner end portion for securing the inner end of said wall-tie element to said other of said wythes.

35. An anchoring apparatus in accordance with claim 34, wherein said enlarged bolt member inner end portion comprises a disc member.

36. An anchoring apparatus in accordance with claim 35, wherein said disc member is of circular configuration.

37. An anchoring apparatus in accordance with claim 30, wherein each of said bores is internally threaded, and said threaded securement is obtained by threaded engagement of said selected pair of coaxially aligned bores with said threaded outer end portion of said bolt.

38. An anchoring apparatus in accordance with claim 37, wherein said bolt member has an enlarged circular disc inner end portion for securing said wall-tie element to said other of said wythes.

39. An anchoring apparatus in accordance with claim 7, wherein said wall-tie element includes a laterally extending rod, said wall-tie element connecting means comprising a helical portion formed at the outer end thereof, and said helical portion and said lateral rod are disposed in substantially coplanar relationship.

40. An anchoring apparatus in accordance with claim 10, wherein said wall-tie element includes a laterally extending rod, said wall-tie element connecting means comprising a helical portion formed at the outer end thereof, and said helical portion and said lateral rod are disposed in substantially coplanar relationship.

41. An anchoring apparatus in accordance with claim 40, wherein said wall-tie element securement means at the inner end thereof comprises an angularly disposed horizontally positioned rod.

42. An anchoring apparatus in accordance with claim 40, wherein said wall-tie element securement means at the inner end thereof comprises an angularly disposed vertically positioned rod.

43. An anchoring apparatus in accordance with claim 39, wherein said one of said wythes is the inner wythe, and said other of said wythes is the outer wythe, said outer wythe comprising a stone masonry construction having stones disposed in adjacent relationship, said wall-tie element securement means comprising angularly disposed rods having selected horizontal and vertical positions with respect to said lateral rod, said vertically positioned angularly disposed rods being secured in a space between two adjacently disposed stones forming a vertical joint therebetween, and said horizontally positioned angularly disposed rods being secured in a space between two adjacently disposed stones forming a horizontal joint therebetween.

44. An anchoring apparatus for use in the construction of wall systems having an inner wythe and an outer wythe in spaced apart relationship and comprising a wall reinforcing assembly, and a wall-tie element, means securing said wall reinforcing assembly with respect to one of said inner and outer wythes, means securing said wall-tie element with respect to the other of said inner and outer wythes, said wall reinforcing assembly comprising a pair of spaced parallel reinforcing members positionally secured within said one of said wythes, and a plurality of members each of which extends laterally of said pair of parallel reinforcing members, means fixedly securing said laterally extending members to at least one of said reinforcing members, the outer ends of said laterally extending members being fixedly disposed in the space between said wythes, said wall-tie element comprising at least one longitudinal rod positionally secured within said other of said wythes, and at least one rod extending laterally from said longitudinal rod, means securing the inner end of said lateral rod to said longitudinal rod, the outer end of said lateral rod being disposed in the space between said wythes, each of said laterally extending members having a U-shaped configuration with the base thereof comprising the fixed outer end of said laterally extending member which is disposed in the space between said wythes, the outer end of said lateral rod terminating in a U-shaped projecting finger disposed substantially perpendicular to said lateral rod, and said U-shaped projecting finger engaging the base of one of said laterally extending members in laterally immovable locking engagement.

45. An anchoring apparatus in accordance with claim 44, wherein said U-shaped projecting finger comprises a pair of arms and a base, one of said arms of said projecting finger being connected to said lateral rod, the other of said arms being longer than said one of said arms and freely disposed with respect to said lateral rod, said freely disposed end of said arm including a projecting member disposed inwardly toward said one arm, and said projecting member being capable of facilitating the initial securement of said projecting finger with respect to the base of said lateral member.

46. An anchoring apparatus in accordance with claim 44, wherein said wall-tie element comprises a pair of rods extending laterally from the ends of said longitudinal rod, said laterally extending rods and said longitudinal rod forming a truncated triangular configuration, the outer ends of said lateral rods being disposed in the space between said wythes, said laterally extending members having a U-shaped configuration with the base thereof comprising the outer end thereof, the outer end of said lateral rods terminating in U-shaped projecting fingers disposed substantially perpendicular to said lateral rods, and both of said U-shaped projecting fingers engaging the base of said laterally extending member in laterally immovable locking engagement.

47. An anchoring apparatus in accordance with claim 46, wherein said U-shaped projecting finger comprises a pair of arms and a base, one of said arms of each of said projecting fingers being connected to a corresponding one of said lateral rods, the other of said arms being longer than said one of said arms and freely disposed with respect to said lateral rod, said freely disposed end of said other arm including a projecting member disposed inwardly toward said one arm, and said projecting member being capable of facilitating the initial securement of said projecting finger with respect to the base of said lateral member.

48. A wall-tie element for use in the construction of wall systems having an inner wythe and an outer wythe in spaced apart relationship and having a longitudinal member fixedly positioned in the space between said wythes, said wall-tie element comprising a laterally disposed body portion, an inner end portion, and an outer end portion, said outer end portion comprising adjustable engagement means for engaging said longitudinal member, and said inner end portion including means capable of securing said wall-tie element to one of said inner and outer wythes.

49. A wall-tie element in accordance with claim 48, wherein said body portion comprises a laterally disposed rod, said inner end portion comprising a longitudinal member secured to said lateral rod, and said outer end portion comprises a U-shaped projecting finger connected to said lateral rod and disposed substantially perpendicular thereto.

50. A wall-tie element in accordance with claim 49, wherein said U-shaped projecting finger comprises a pair of arms and a base, one of said arms of said projecting finger being connected to said lateral rod, the other of said arms being longer than said one of said arms and freely disposed with respect to said lateral rod, said freely disposed end of said other arm including a projecting member disposed inwardly toward said one arm, and said projecting member being capable of facilitating the initial securement of said projecting finger with respect to said longitudinal member.

51. A wall-tie element in accordance with claim 48, wherein said inner end portion comprises a longitudinally disposed rod, said laterally disposed body portion comprising a pair of lateral rods connected to the ends of said longitudinal rod, said outer end portion comprises a U-shaped projecting finger connected to each of said lateral rods, and said U-shaped projecting fingers being disposed substantially perpendicular to said lateral rods.

52. A wall-tie element in accordance with claim 51, wherein each of said U-shaped projecting fingers comprises a pair of arms and a base, one of said arms of each of said projecting fingers being connected to a corresponding one of said lateral rods, the other of said arms being longer than said one of said arms and freely disposed with respect to said lateral rod, each of said freely disposed ends of said other arms including a projecting member disposed inwardly toward said one arm, and said projecting members being capable of facilitating the initial securement of said projecting fingers with respect to said longitudinal member.

53. A wall-tie element in accordance with claim 52, wherein said lateral rods are disposed in converging relationship with respect to one another, and said longitudinal rod and said lateral rod having a truncated triangular configuration.

54. A wall-tie element in accordance with claim 48, wherein said inner end portion comprises a laterally disposed corrugated member, the other end of said lateral body portion comprising trifurcated fingers disposed substantially perpendicular to said body portion, and forming said outer end portion of said wall-tie element, two of said fingers are coplanar and the third one of said fingers disposed in a parallel spaced apart plane, and wherein said fingers are capable of engaging said longitudinal member.

55. A wall-tie element in accordance with claim 54, wherein said outer fingers comprise said two fingers and are disposed in coplanar relationship, and said third finger is the center finger of said trifurcated fingers.

56. A wall-tie element in accordance with claim 55, wherein the plane of said third finger extends outwardly of said body portion a distance greater than the plane of said two fingers.

57. A wall-tie element in accordance with claim 48, wherein said inner end portion comprises an arcuate member, and the outer end of said body portion comprising bifurcated fingers disposed substantially perpendicular to said body portion and forming said outer end portion of said wall-tie element.

58. A wall-tie element in accordance with claim 57, wherein said entire wall-tie element is formed of a singular rod member, said rod member having a rounded portion comprising the inner end portion of said wall tie element, the ends of said rod member being disposed adjacent one another for a predetermined distance to form said lateral body portion, and said ends of said arod member being bent at substantially right angles in spaced apart relationship to form said bifurcated fingers comprising said outer end portion of said wall-tie element.

59. A wall-tie element in accordance with claim 48, wherein said body comprises a laterally disposed rod, said outer end portion comprises a helical portion formed at the outer end of said lateral rod, and said helical portion and said lateral rod being disposed in substantially coplanar relationship.

60. A wall-tie element in accordance with claim 59, wherein said inner end portion comprises a horizontally disposed longitudinal rod.

61. A wall-tie element in accordance with claim 59, wherein said inner end portion comprises a vertically disposed rod.

62. A wall-tie element in accordance with claim 48, wherein said body portion comprises a bolt having a threaded outer end portion, said outer end portion comprising a U-shaped member having a base portion, and a pair of arms, said arms being secured to said base portion and having a pair of coaxially aligned bores formed therein, said bores being disposed in laterally offset relationship with respect to one another, at least one of said arms including threaded engagement means associated therewith, and said threaded outer end portion of said bolt passing through said coaxially aligned bores and being positionally disposed therethrough by threaded securement of said threaded outer end portion by said threaded engagement means.

63. A wall-tie element in accordance with claim 62, wherein said inner end portion comprises an enlarged longitudinally disposed disc secured to the inner end of said bolt.

64. A wall-tie element in accordance with claim 63, wherein said enlarged disc is of circular configuration.

65. A wall-tie element for use in the construction of wall structures having an inner wythe and an outer wythe in spaced apart relationship and having a longitudinal member fixedly positioned in the space between said wythes, said wall-tie element comprising a U-shaped member, and a bolt member, said U-shaped member comprising a base portion, and a pair of arms, said arms being secured to said base portion and having a pair of coaxially aligned bores formed therein, said bores being disposed in laterally offset relationship with respect to one another, said bolt member including a laterally extending bolt having a threaded outer end portion, said base portion being capable of being positioned upon said longitudinal member, at least one of said arms including threaded engagement means associated therewith, and said threaded outer end portion of said bolt passing through said coaxially aligned bores and being positionally disposed therethrough by threaded securement of said threaded outer end portion by said threaded engagement means.

66. A wall-tie element in accordance with claim 65, wherein said U-shaped member is of channel construction having the base thereof disposed in a plane which is mutually perpendicular to the planes of the arms thereof.

67. A wall-tie element in accordance with claim 66, wherein said longitudinal member is of rectilinear cross-section.

68. A wall-tie element in accordance with claim 65, wherein said threaded engagement means associated with said one of said arms comprises the internal threading of said bore formed in said one of said arms.

69. A wall-tie element in accordance with claim 65, wherein said threaded engagement means comprises a pair of nuts positionally disposed on either side of said arms on the exterior surface thereof and threadedly engaging the threaded outer end portion of said bolt.

70. A wall-tie element in accordance with claim 69, wherein
each of said bores is internally threaded for engagement with the threaded outer end portion of said bolt.

71. A wall-tie element in accordance with claim 65, wherein
said bolt member includes an enlarged inner end portion.

72. A wall-tie element in accordance with claim 71, wherein
said enlarged bolt member inner end portion comprises a disc member.

73. A wall-tie element in accordance with claim 72, wherein
said disc member is of circular configuration.

74. A wall-tie element in accordance with claim 65, wherein
the height of said arms is substantially equal to the width of the base portion of said U-shaped member.

75. A wall-tie element in accordance with claim 65, wherein
the height of said arms is equal to between two to three times the width of the base portion of said U-shaped member.

76. A wall-tie member element in accordance with claim 65, wherein
each of said arms of said U-shaped member have an L-shaped configuration,
the horizontally disposed portions of each of said L-shaped arms having a plurality of substantially horizontally aligned bores formed therein,
corresponding ones of the bores in each of the arms being disposed in coaxial alignment, and
said bolt member being capable of threaded engagement within a selected one of said coaxial pairs of bores.

77. A wall-tie element in accordance with claim 76, wherein
said U-shaped member is of channel construction having the base thereof disposed in a plane which is mutually perpendicular to the planes of said L-shaped arms.

78. A wall-tie element in accordance with claim 77, wherein
said longitudinal member is of rectilinear cross-section.

79. A wall-tie element in accordance with claim 77, wherein
said threaded engagement means comprises a pair of nuts positionally disposed on either side of said arms on the exterior surface thereof and threadedly engaging the threaded outer end portion of said bolt, and
the axis of said bolt being coaxial with said selected pair of bores and said nuts.

80. A wall-tie element in accordance with claim 76, wherein
said bolt member includes an enlarged inner end portion.

81. A wall-tie element in accordance with claim 80, wherein
said enlarged bolt member inner end portion comprises a disc member.

82. A wall-tie element in accordance with claim 81, wherein
said disc member is of circular configuration.

83. A wall-tie element in accordance with claim 76, wherein
each of said bores is internally threaded, and
said threaded securement is obtained by threaded engagement of said selected pair of coaxially aligned bores with said threaded outer end portion of said bolt.

84. A wall-tie element in accordance with claim 83, wherein
said bolt member has an enlarged circular disc inner end portion.

85. An anchoring apparatus for use in the construction of wall structures having an inner wythe and an outer wythe in spaced apart relationship and comprising
a wall reinforcing assembly, and
a wall-tie element,
means for securing said wall reinforcing assembly with respect to one of said inner and outer wythes,
means for securing said wall-tie element with respect to the outer of said inner and outer wythes,
said wall reinforcing assembly comprising
a pair of spaced parallel reinforcing members positionally secured within said one of said wythes, and
a plurality of members extending laterally of said pair of parallel reinforcing members, means fixedly securing said laterally extending members to at least one of said reinforcing members,
the outer ends of said laterally extending members having eyelets formed thereat and being disposed in the space between said wythes,
successive vertical courses of said wall reinforcing assembly being horizontally offset with respect to one another thereby positioning vertically adjacent ones of said eyelets in vertically skew relationship,
a plurality of rod members having arcuate upper end portions,
said rod members being positioned within vertically adjacent ones of said eyelets,
said rod members being disposed in vertically skew relationship and having the upper arcuate portions thereof engaging the upper one of a pair of vertically adjacent eyelets and the lower portions thereof disposed in the lower one of said pair of vertically adjacent eyelets,
said lower one of said vertically adjacent eyelets also having the arcuate upper portion of a rod member engagingly disposed therein,
the outer end of said wall-tie element being slidably secured upon one of said rod members for vertical and horizontal adjustability of said wall-tie element, and
the inner end of said wall-tie element being connected to the other of said wythes.

86. An anchoring apparatus in accordance with claim 85, wherein
said wall-tie element includes a lateral rod, and
the outer end of said wall-tie element comprising a helical portion connected to said lateral rod.

87. An anchoring apparatus in accordance with claim 86, wherein
said inner end of said wall-tie element comprises a horizontally disposed longitudinal rod connected to said lateral rod.

88. An anchoring apparatus in accordance with claim 86, wherein said inner end of said wall-tie element comprises a vertically disposed rod connected to said lateral rod.

89. An anchoring apparatus in accordance with claim 85, wherein said wall-tie element comprises
a U-shaped member, and
a bolt member, said U-shaped member comprising
a base portion, and
a pair of arms, said arms being secured to said base portion and having a pair of coaxially aligned bores formed therein, said bores being disposed in laterally offset relationship with respect to one another, said bolt member including a laterally extending bolt having a threaded outer end portion, said base portion being positioned upon said one of said rod members, at least one of said arms including threaded engagement means associated therewith, and said threaded outer end portion of said bolt passing through said coaxially aligned bores and being positionally disposed therethrough by threaded securement of said threaded outer end portion by said threaded engagement means.

90. An anchoring apparatus in accordance with claim 89, wherein said U-shaped member is of channel construction having the base thereof disposed in a plane which is mutually perpendicular to the planes of the arms thereof.

91. An anchoring apparatus in accordance with claim 89, wherein said threaded engagement means associated with said one of said arms comprises the internal threading of said bore formed in said one of said arms.

92. An anchoring apparatus in accordance with claim 89, wherein said threaded engagement means comprises a pair of nuts positionally disposed on either side of said arms on the exterior surface thereof and threadedly engaging the threaded outer end portion of said bolt.

93. An anchoring apparatus in accordance with claim 91, wherein each of said bores is internally threaded for engagement with the threaded outer end portion of said bolt.

94. An anchoring apparatus in accordance with claim 93, wherein said bolt member has an enlarged circular disc inner end portion for securing said wall-tie element to said other of said wythes.

* * * * *

UNITED STATES PATENT OFFICE

CERTIFICATE OF CORRECTION

Patent No. 3,964,227 Dated June 22, 1976

Inventor(s) Alfred A. Hala

It is certified that error appears in the above-identified patent and that said Letters Patent are hereby corrected as shown below:

Column 12, claim 6, delete lines 6, 7 and 8.

Column 19, claim 58, line 10, "arod" should read -- rod --.

Column 22, claim 85, line 7, after "means" delete "for";

Column 22, claim 85, line 9, after "means" delete "for".

Column 22, claim 85, lines 16 to 18, delete "means fixedly securing said laterally extending members to at least one of said reinforcing members," and insert -- means fixedly securing said laterally extending members to at least one of said reinforcing members, --.

Column 22, claim 85, line 10, "outer" should read -- other --.

Signed and Sealed this

Fifth Day of October 1976

[SEAL]

*Attest:*

RUTH C. MASON
*Attesting Officer*

C. MARSHALL DANN
*Commissioner of Patents and Trademarks*